US007097547B2

(12) United States Patent
McCroary

(10) Patent No.: US 7,097,547 B2
(45) Date of Patent: Aug. 29, 2006

(54) HANDHELD SKATE SHARPENER

(75) Inventor: Robert McCroary, P.O. Box 898, Redwater, Alberta (CA) T0A 2W0

(73) Assignee: Robert McCroary, Redwater (CA)

( * ) Notice: Subject to any disclaimer, the term of this patent is extended or adjusted under 35 U.S.C. 154(b) by 46 days.

(21) Appl. No.: 10/515,292

(22) PCT Filed: May 23, 2003

(86) PCT No.: PCT/CA03/00755

§ 371 (c)(1),
(2), (4) Date: May 26, 2005

(87) PCT Pub. No.: WO03/099395

PCT Pub. Date: Dec. 4, 2003

(65) Prior Publication Data

US 2006/0030248 A1 Feb. 9, 2006

Related U.S. Application Data

(60) Provisional application No. 60/319,267, filed on May 24, 2002.

(51) Int. Cl.
*B24B 1/00* (2006.01)

(52) U.S. Cl. ..... 451/303; 451/296; 451/297; 451/513; 451/524

(58) Field of Classification Search ..... 451/296, 451/297, 299, 303, 513, 514, 523, 524
See application file for complete search history.

(56) References Cited

U.S. PATENT DOCUMENTS

| | | | | | |
|---|---|---|---|---|---|
| 1,722,400 | A | * | 7/1929 | Stevens | 451/515 |
| 2,550,765 | A | * | 5/1951 | Brown | 451/523 |
| 2,563,018 | A | | 8/1951 | Fello | |
| 3,125,833 | A | | 3/1964 | Wilde | |
| 3,164,932 | A | | 1/1965 | Morith | |
| 3,812,626 | A | | 5/1974 | Thompson | |
| 3,841,030 | A | * | 10/1974 | Laszlo | 451/358 |
| 3,881,280 | A | | 5/1975 | Thompson | |
| 4,043,082 | A | * | 8/1977 | Ferroglio | 451/311 |
| 4,219,975 | A | | 9/1980 | Scholler | |
| 4,403,455 | A | * | 9/1983 | Chiasson | 451/303 |
| 4,615,144 | A | | 10/1986 | Peacock et al. | |
| 4,730,430 | A | * | 3/1988 | Petrovich | 451/519 |
| 4,756,125 | A | | 7/1988 | Kadnar | |
| 5,168,658 | A | * | 12/1992 | Price | 451/311 |
| 5,197,232 | A | * | 3/1993 | Ellestad | 451/558 |
| 5,591,069 | A | | 1/1997 | Wurthman | |
| 5,720,654 | A | * | 2/1998 | Mac Donald | 451/523 |
| 6,368,196 | B1 | | 4/2002 | Bauer | |

FOREIGN PATENT DOCUMENTS

| | | | |
|---|---|---|---|
| CA | 2249931 | | 4/2000 |
| CA | 2285765 | | 4/2000 |
| FR | 2495526 | | 12/1980 |
| GB | 2304063 | | 1/1995 |
| GB | 2304063 | * | 3/1997 |
| WO | WO 97/05988 | | 2/1997 |

* cited by examiner

*Primary Examiner*—Eileen P. Morgan
(74) *Attorney, Agent, or Firm*—Bennett Jones LLP

(57) ABSTRACT

The invention provides for a powered hand held apparatus for sharpening ice skate blades having an elongated frame with a drive pulley located at one and, and a driven pulley located at the other end. An abrasive grinding belt loops over the pulleys and passes over a convex grinding surface aligned with the pulleys. The pulleys, frame, drive belt, grinding belt and electric motor are contained in a housing having a skate guidance slot such that when a skate is inserted into the slot, the bottom edge of the skate is directed to the abrasive belt at the convex grinding surface.

30 Claims, 9 Drawing Sheets

HANDHELD SKATE SHARPENER

This application claims benefit of 60/319,267 filed May 24, 2002.

FIELD OF THE INVENTION

The present invention relates to a skate-sharpening device for sharpening ice skate blades.

BACKGROUND OF THE INVENTION

The usual method for sharpening skate blades involves the use of a motor driven grinding machine. Such machines generally work by subjecting the edge of the ice skate blade to a large rotating grinding wheel at a fixed and constant angle. These grinding machines are large, heavy and not portable. Consequently, such machines are generally not owned and operated by individual skaters, rather they are found in such places as sports equipment stores and ice arenas.

There have been attempts to create manual handheld skate sharpening devices that are compact enough to fit into a bag or a pocket. They are usually operated by pushing the device along the length of the skate blade which subjects the bottom edge of the skate blade to a grinding element. Because of the stationary, or relatively slowly rotating grinding surface, such devices have limited performance capabilities and do not sharpen as well as their powered counterparts. Such devices are often unwieldy to use and impractical for users who lack the strength to move the device along the blade with sufficient force.

Attempts have also been made to design portable or handheld powered skate sharpening devices. Many are adaptable to be affixed to powered tools such as drills. These devices all utilize the power source to rotate a hard grinding element against the skate blade. To facilitate attachment to the power tool, many use an elongated arm that is connected to a drive arbor that rotates the grinding stone. The use of such an elongated arrangement reduces stability and can result in the grinding stone vibrating or bouncing as it moves against the blade edge. This results in reduced sharpening efficiency and can cause the stone to dig into the blade or 'bite' which results in burrs and nicks in the blade.

Further, many of these powered portable sharpening devices apply the grinding stone transversely to the skate blade. This means that scratches and aberrations caused by the stone during the sharpening are perpendicular to the skate blade. This reduces the gliding efficiency of the skate blade.

Another problem with many of the powered portable sharpening devices is that of inadequate stability and insufficient guidance during the application of the grinding stone to the skate edge. When the skate edge is applied to the grinding surface there is significant vibration or chatter, and accordingly there will be a tendency for the skate blade and the sharpener to move. Any such movement will reduce the trueness of the sharpened edge. Ideally, the blade must be subjected to the grinding surface at a constant angle and a constant pressure. Many of the powered portable sharpening devices require the device to be mounted on a fixed horizontal surface such as a table to facilitate steady guidance of the blade onto the grinding surface. Such devices are generally impractical to use in the locker room setting and unduly limit the users ability to place the device in their bag and use it prior to skating. Further, if a fixed horizontal surface is unavailable, the user will be unable to maintain stability and guidance during the sharpening process.

A further problem with the existing powered portable sharpening devices is wear of the grinding elements. As the grinding profile on the element wears it will reduce the ability of the device to deliver a consistent grind profile. Regular replacement of the grinding element is inconvenient and expensive.

There is a need in the art for a powered portable skate-sharpening device that mitigates the disadvantages of the prior art.

SUMMARY OF THE INVENTION

The present invention is directed to a handheld apparatus for sharpening the bottom edge of a skate blade. The apparatus utilizes an abrasive grinding belt that rotates about a pulley system. The skate blade contacts the abrasive belt on a convex grinding surface and is guided by a slot in the housing of the apparatus; this results in a consistent grinding profile. The grinding surface moves longitudinally with the blade and the elimination of a grinding stone reduces the aforementioned problems chatter and vibration. In one embodiment, the arbor driving the pulleys is relatively short and connects directly to a power tool promoting stability. In another embodiment, an electric motor is provided with the device. The abrasive grinding belts and grinding surface are easily removable and inexpensive to replace. Further, the device does not require a fixed surface and can be held in the user's hands throughout the sharpening process.

Accordingly, in one aspect, the invention comprises an apparatus comprising:

(a) an electric motor;

(b) a drive shaft driven by the electric motor;

(c) an extendible frame having a first and second end, the frame having a first drive pulley connected to the drive shaft at its first end, and a second pulley at its second end, the frame having a bias means for pushing the first and second pulleys apart and the frame having an elongated convex grinding surface;

(d) a grinding belt with an abrasive upper surface looping over both pulleys and the convex grinding surface; and (e) the electric motor, drive shaft, frame, grinding belt and pulleys being contained within a housing, the housing having a blade guidance slot aligned with the abrasive belt and convex grinding surface.

Accordingly, in another aspect, the invention comprises an apparatus comprising:

(a) a drive bushing including means to releasably attach the drive bushing to a power tool;

(b) an extendible frame having a first and second end, a first drive pulley connected to the drive bushing at its first end, a second pulley at its second end, a biasing means pushing the first and second pulleys apart, and an elongated convex grinding surface;

(c) a grinding belt with an abrasive upper surface looping over both pulleys and the convex grinding surface, and (d) the frame, grinding belt and pulleys being contained within a housing, said housing having a blade guidance slot aligned with the abrasive belt and convex grinding surface.

In another aspect, the invention comprises an apparatus comprising:

(a) an arbor having attachment means for attaching to a hand-held power tool;

(b) an extendible main frame having a first drive pulley connected to the arbor at its first end, and a front pulley support at its second end holding a second pulley;

(c) biasing means mounted between the main frame and the front pulley support;

(d) a convex grinding surface mounted to the surface of said main frame;

(e) a grinding belt with an abrasive upper surface looping over both pulleys and the convex grinding surface; and (f) a housing containing the main frame, pulley support, belt and pulleys with a blade guidance slot aligned with the abrasive belt at the convex grinding surface.

In one embodiment, the biasing means is a coil spring. In further embodiments the housing may be comprised of two separable pieces and the width of the guidance slot may be adjustable. The housing may have an exhaust port in an area adjacent to the convex grinding surface. In one embodiment the attachment means and drive bushing are comprised of a hollow threaded arbor. In another embodiment the convex grinding surface is a detachable plate. In a further embodiment, the frame has a groove to accommodate the convex grinding surface. In one embodiment, the surface of the frame with the groove is also a detachable plate. In another embodiment, blade guides for guiding the skate to the convex grinding surface are detachably mounted to the housing at the entrance of the guidance slot.

BRIEF DESCRIPTION OF THE DRAWINGS

The invention will now be described by way of an exemplary embodiment with reference to the accompanying simplified, diagrammatic, not to scale drawings. In the drawings.

DETAILED DESCRIPTION OF THE INVENTION

Figure 13:
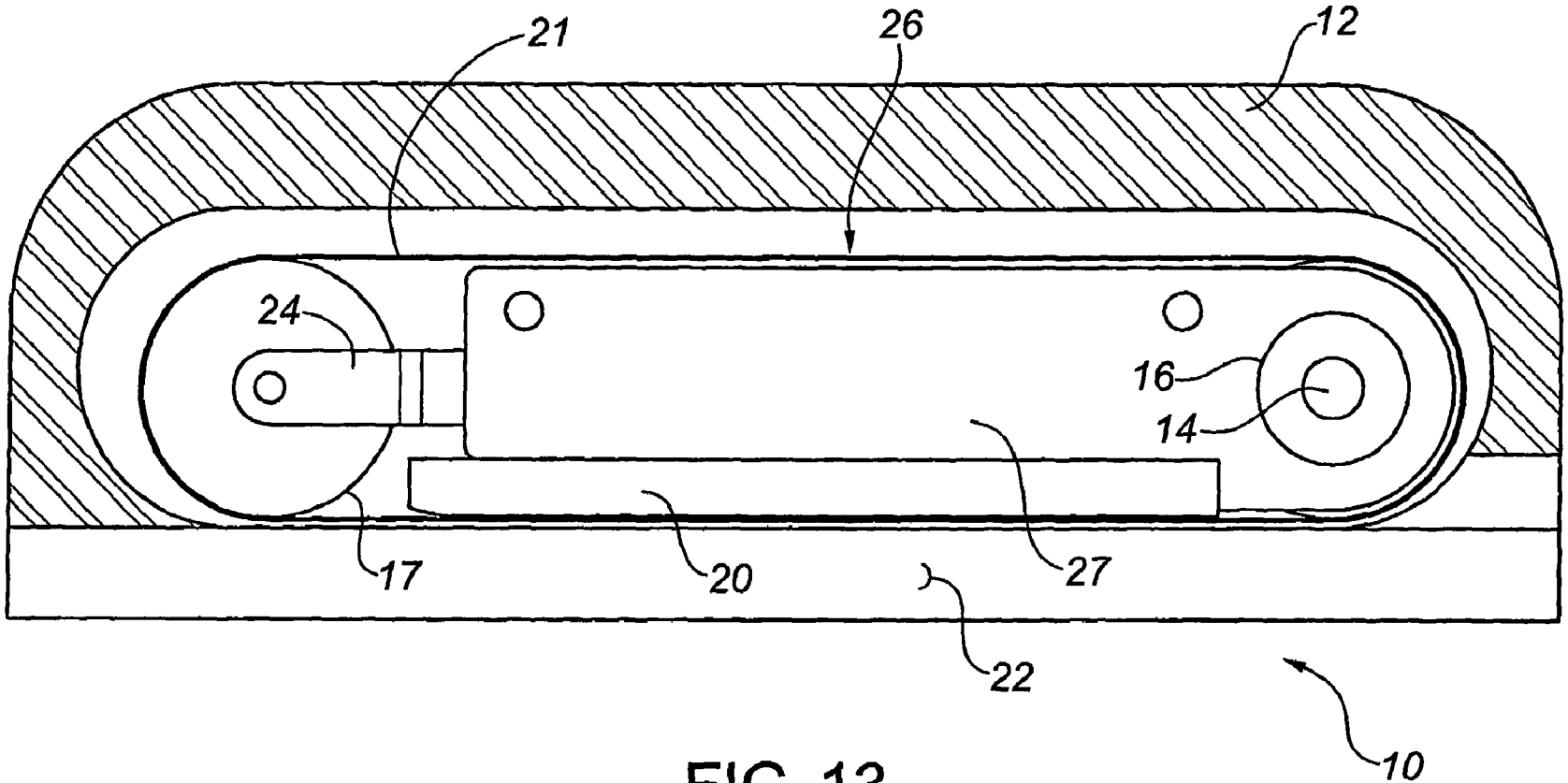
FIG. 13 is a sectional side view of the apparatus of one embodiment of the apparatus.
Figure 14:
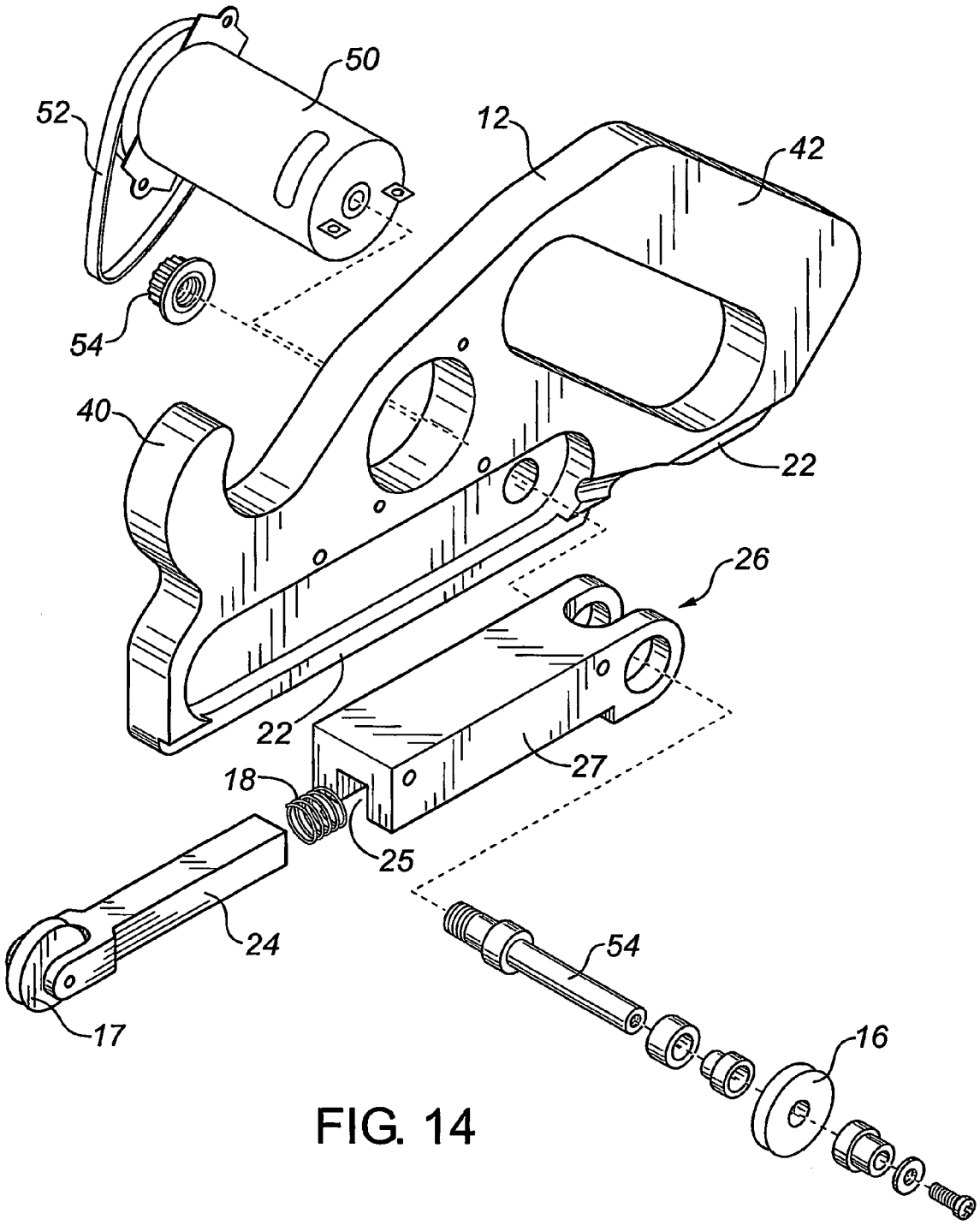
FIG. 14 is a sectional side view of one half of the housing of one embodiment of the apparatus.

As is depicted in FIG. 14, the apparatus (10) in one embodiment comprises an electric motor (50), a drive shaft (54) and a drive belt (52) connecting the electric motor (50) to the drive shaft (54). The drive shaft (54) is directly connected to a first drive pulley (16) located at one end of an extendible frame (26). A second pulley (17) is located at the other end of the frame (26) with a grinding belt (21) having an abrasive upper surface looping over both drive pulleys (16,17) as depicted in FIG. 13. Biasing means (18) such as a coil spring pushes the two drive pulleys (16,17) apart maintaining tension in the grinding belt (21) and preventing it from slipping off the drive pulleys (16,17). The frame (26) has a convex grinding surface (20) that the grinding belt (21) passes over.

The motor (50), frame (26), drive pulleys (16,17) and grinding belt (21) are all contained within a housing (12). The housing (12) has a longitudinal guidance slot (22) designed to accommodate the bottom edge of an ice skate.

The electric motor (50) may use battery powered (not shown) or my be an AZ motor using conventional household AC power.

Figure 1:
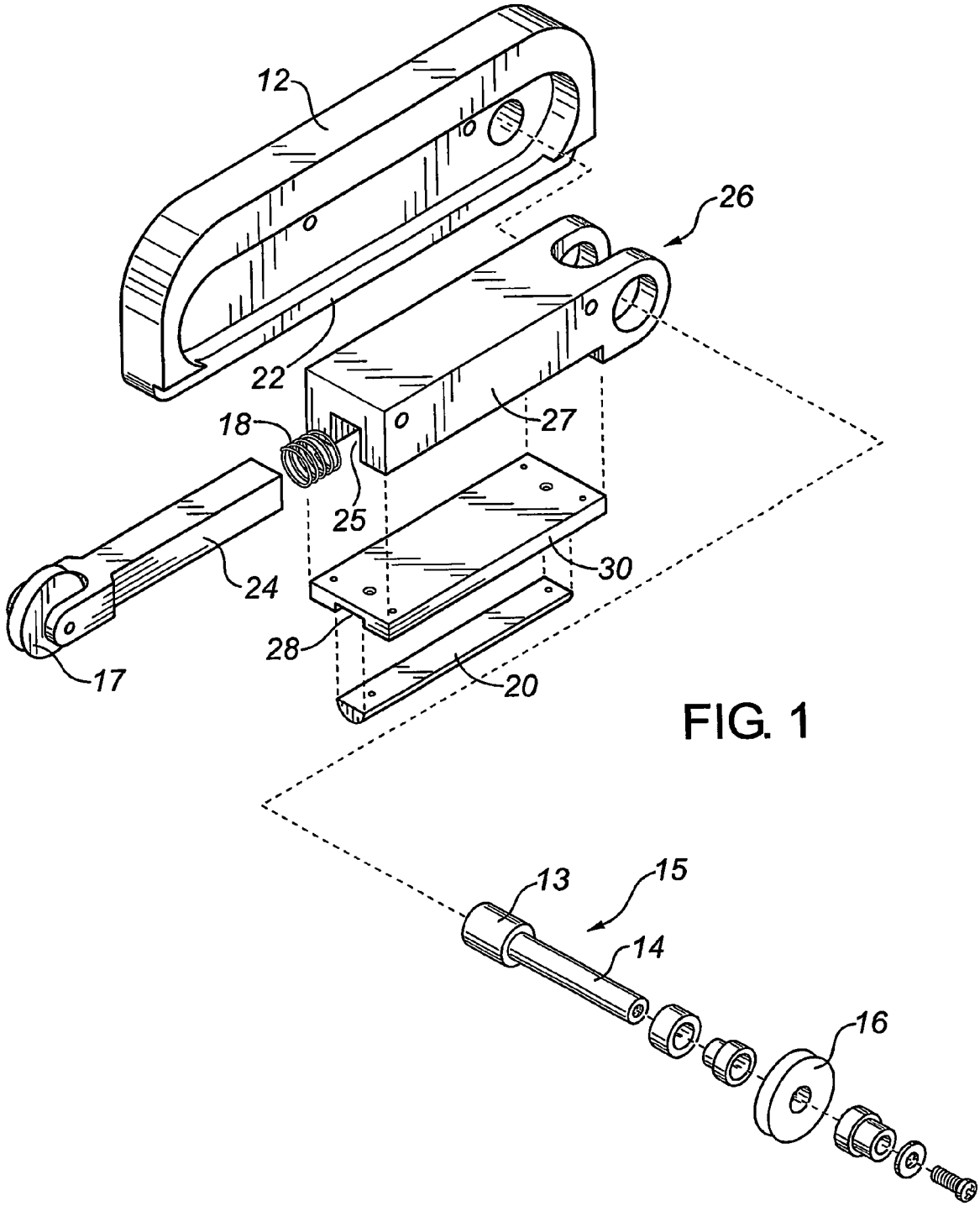
FIG. 1 is an exploded view of one embodiment of the apparatus showing the relationship between the various invention components.

As is depicted in FIG. 1, in one embodiment the apparatus (10) may not have an internal electric motor but rather an attachment means (13) for attaching a drive bushing (14) to a power tool, the drive bushing (14) being directly connected to the first drive pulley (16).

In a further embodiment, the attachment means (13) and drive bushing (14) may be combined as a single hollow arbor (15) as depicted in FIG. 1. The interior of the arbor (15) maybe threaded to facilitate direct attachment to the male threaded arbor of a power tool such as a Dremel™ or an electric drill. The power tool may be cordless (battery powered) or corded to use conventional AC power. Such an arrangement minimizes the length of the arbor (15) rotating the first drive pulley (16) promoting stability and reducing the tendency of the apparatus (10) to bounce or vibrate during operation. In another embodiment, a narrow solid arbor may be utilized which is adapted to fit various chucks or collets.

Figure 5:
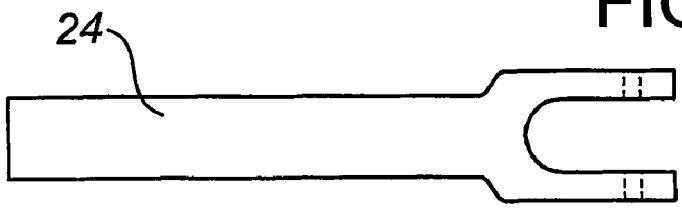
FIG. 5 is a sectional top view of the front pulley support of one embodiment of the apparatus.
Figure 6:
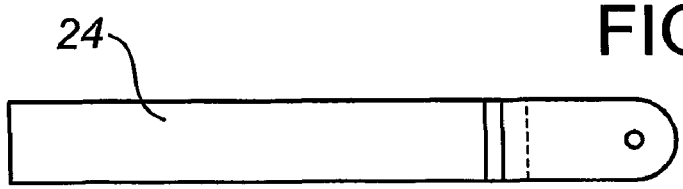
FIG. 6 is a sectional side view of the front pulley support of one embodiment of the apparatus.
Figure 7:
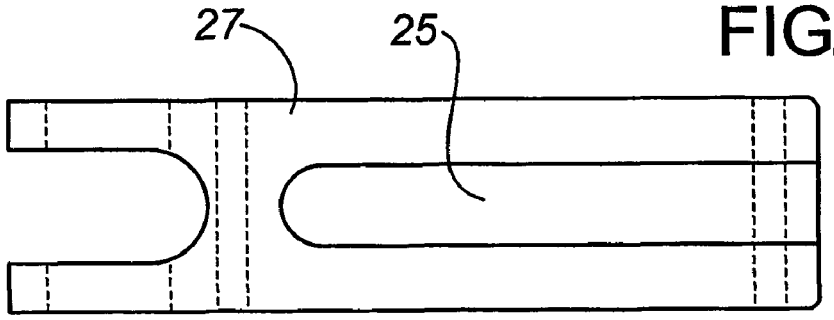
FIG. 7 is a sectional top view of the main frame of one embodiment of the apparatus.
Figure 8:
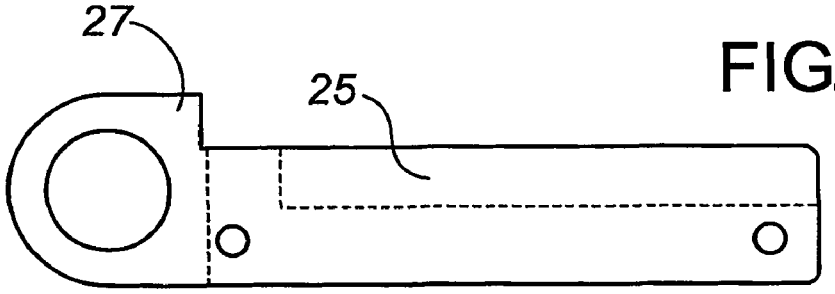
FIG. 8 is a sectional side view of the main frame of one embodiment of the apparatus.

As depicted in FIGS. 1 and 5 to 8, the extendible frame (26) may be comprised of a main frame (27) and an associated front pulley support (24). As shown in FIGS. 1, 5 and 6, the front pulley support (24) may be forked at one end to secure the second pulley (17). The other end of the front pulley support (24) slidingly engages the main frame (27). In one embodiment, the front pulley support (24) may insert into a cavity (25) on the main frame (27) as shown in FIGS. 1, 7 and 8. As shown in FIG. 1, biasing means (18) may be placed between the main frame (27) and the front pulley support (24) to maintain tension in the grinding belt (21). This tension prevents the grinding belt (21) from slipping off the drive pulleys and pulls the main frame (27) and front pulley support (24) together. The biasing means (18) also creates a constant level of tension in the grinding belt (21) which promotes a consistent grind profile on the skate blade. The bias means (18) may be a coil spring or such other suitable biasing means as may be chosen by one skilled in art. To remove and replace the grinding belt (21), the spring (18) is compressed to reduce the distance between the drive pulleys. This causes the grinding belt (21) to lose tension and sag facilitating its removal or replacement. The grinding belts are relatively inexpensive and therefore they can be regularly changed by the owner to enable optimum performance and to promote a consistent grind profile.

The grinding belts should have sufficient strength to resist breakage or damage during the sharpening process. One skilled in the art may choose and install any suitable grinding belt. One suitable abrasive grinding belt is a quarter inch width, 707E JE Weight Cloth belt with a blended ceramic aluminum oxide abrasive surface. Grinding belts with varying degrees of coarseness may be utilized depending on the extent of damage that exists on the skate blade.

Figure 2:
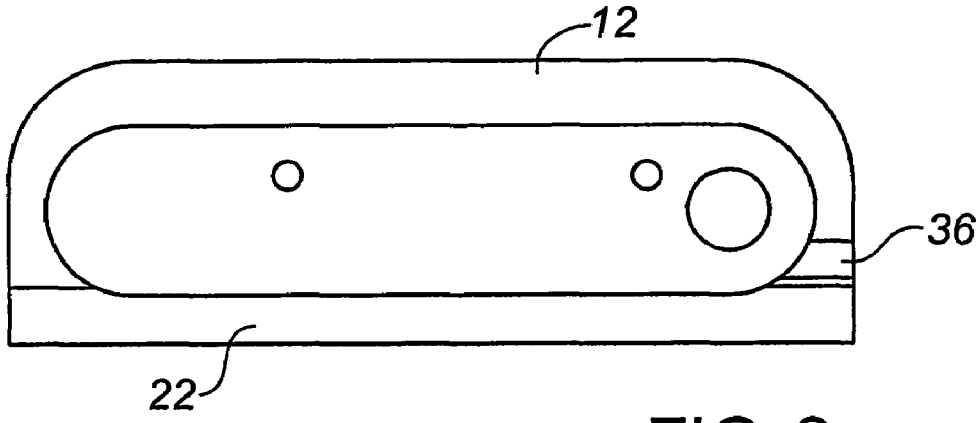
FIG. 2 is a side view of one half of the housing of one embodiment of the apparatus.
Figure 3:
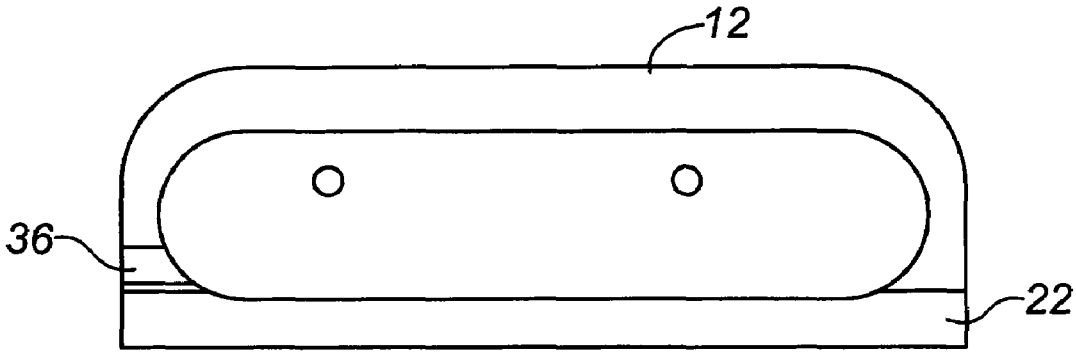
FIG. 3 is a side view of the other half of the housing of one embodiment of the apparatus.
Figure 4:
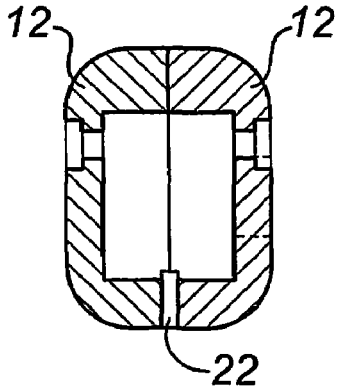
FIG. 4 is a longitudinal section view of the housing and the guidance groove of one embodiment of the apparatus.
Figure 15:
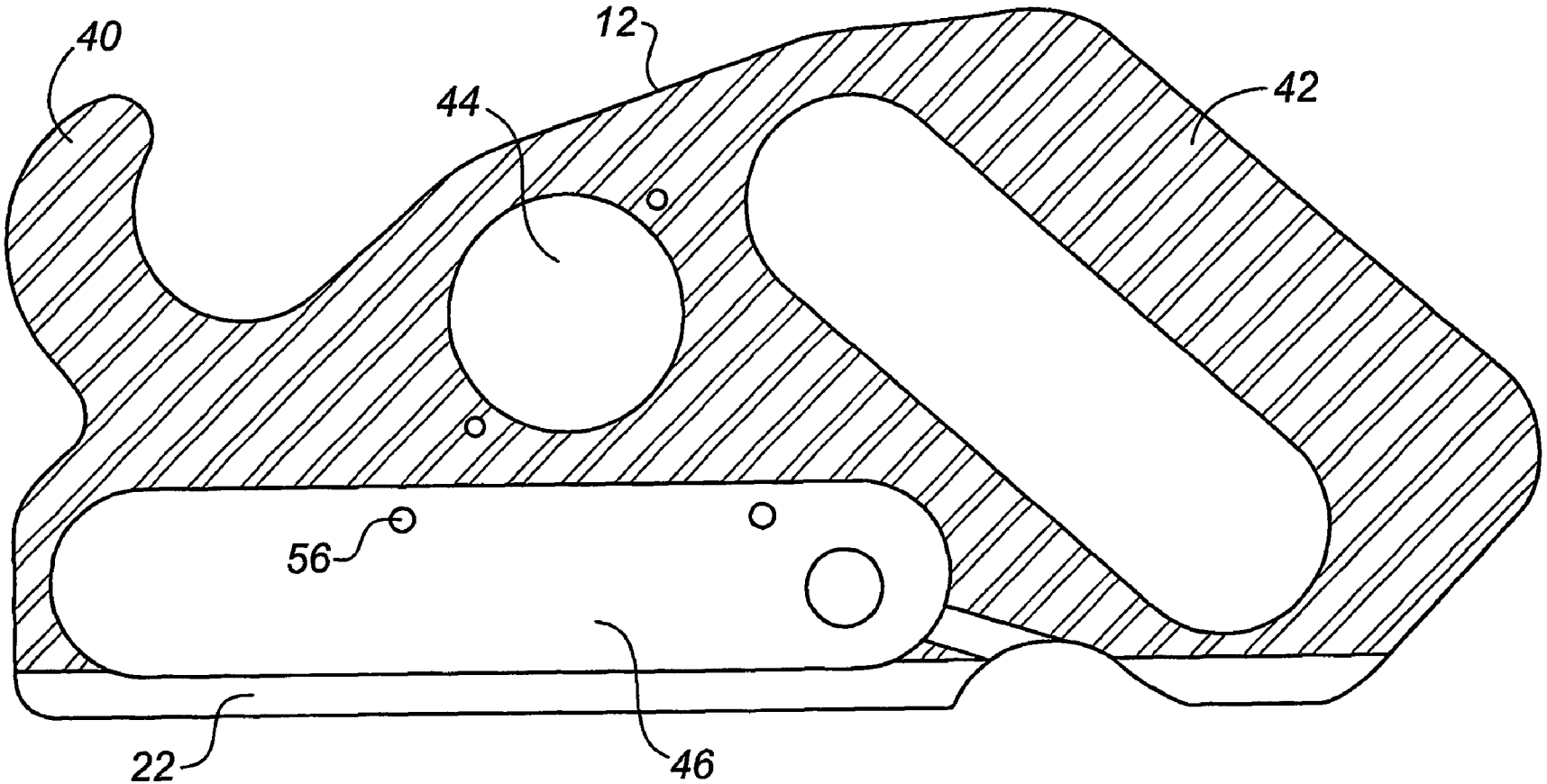
FIG. 15 is a sectional side view of one half of the housing of one embodiment of the apparatus.
Figure 16:
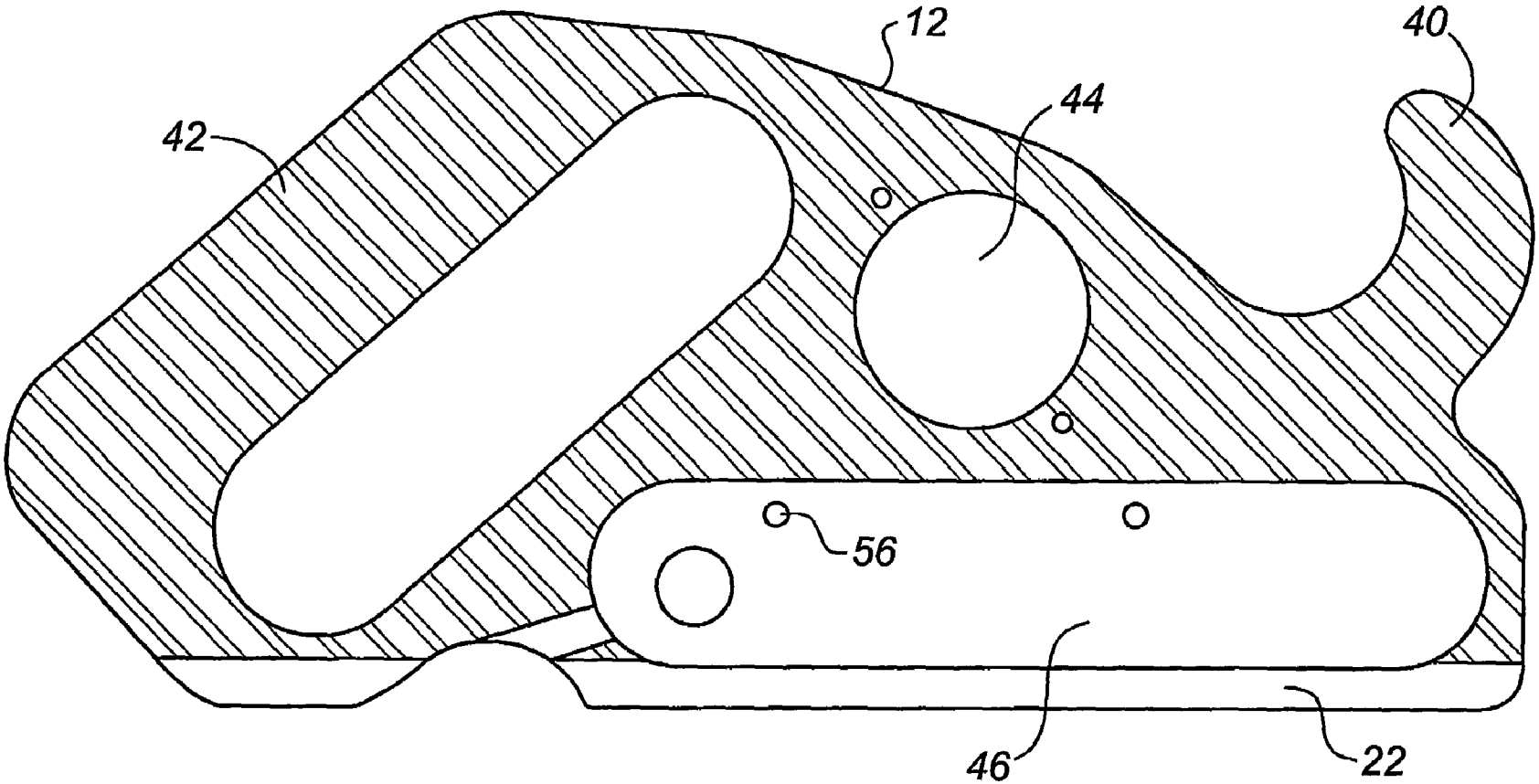
FIG. 16 is a sectional side view of one half of the housing of one embodiment of the apparatus.

In one embodiment, the housing (12) comprises two separable halves to facilitate access to the internal components as depicted in FIGS. 2, 3, 4, 15, and 16. This permits such activities as changing a worn grinding belt (21). When the two halves of the housing (12) are joined, the guidance slot (22) is formed at a fixed width as depicted in FIGS. 2, 3 and 4. In one embodiment, there may be an adjustment means to alter the width of the guidance slot (22) to permit the use of the apparatus (10) with ice skates of varying blade width. For example, ice hockey goal tenders skate blades are generally wider than regular skate blades. As depicted in FIGS. 1 and 8, an attachment means may pass through each half of the housing (12) into the main frame, holding the two halves together and holding the internal components in a fixed position within the housing (12). As shown in FIGS. 15 and 16, in another embodiment, each half of the housing may have mounting screw holes (56) through which screws are inserted into each side of the extendible frame (26) thereby holding the two halves of the housing (12) together.

Figure 17:
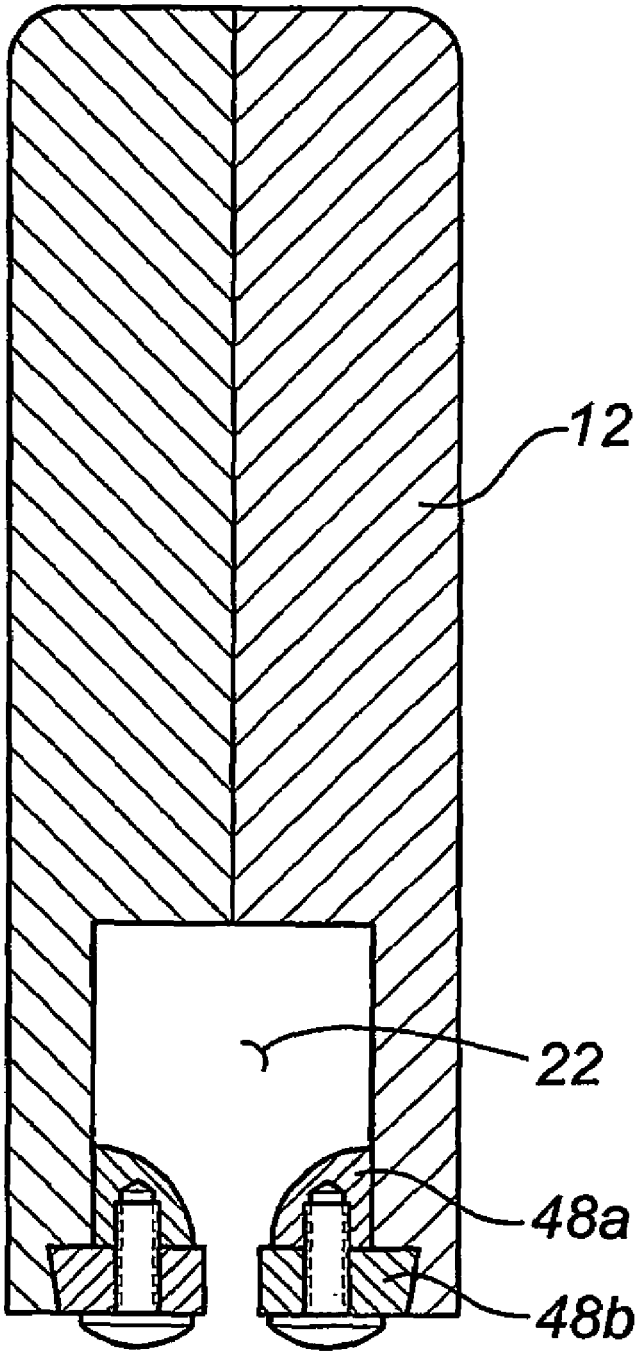
FIG. 17 is a sectional end view of one embodiment of the apparatus.

The guidance slot (22) directs the blade to the convex grinding surface (20) and prevents any movement of the skate blade as it is sharpened. In a further embodiment shown in FIG. 2, the housing (12) may have an exhaust port (36) to facilitate the expulsion of smoke, sparks and debris from the apparatus (10). As depicted in FIG. 17, in one embodiment the apparatus (10) may have blade guides (48) for guiding the skate to the convex grinding surface. The blade guides (48) may be formed of two pieces. A first piece (48*a*) may be permanently attached to housing (12) and form a shoulder to which the second piece (48*b*) attaches. The width of the slot (22) is determined by the size of the second piece (48*b*). The second piece may be detachably mounted to the housing (12) at the entrance of the guidance slot (22) by means of bosses and adjustable thumbscrews, however such other suitable mounting means as would be selected by one skilled in the art may also be used. In one embodiment, the second piece engages the housing by means of a partial dovetail groove, as shown in FIG. 17.

As shown in FIGS. 15 and 16, in one embodiment, the separable halves of the housing (12) may be shaped such that when they are joined they form a front handle (40) and a rear handle (42) that can be grasped during operation. As also shown in FIGS. 15 and 16, the housing (12) may also have a recess to house an electric motor (44) positioned above a recess to house the extendible frame and associated components (46).

Figure 9:
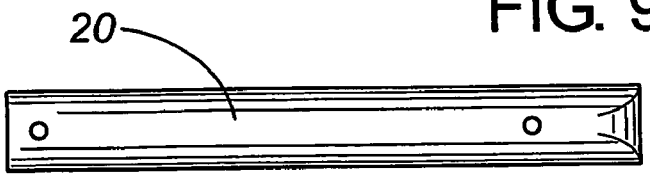
FIG. 9 is a sectional top view of convex plate of one embodiment of the apparatus.
Figure 10:
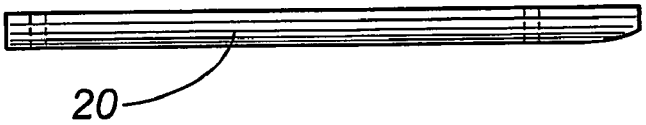
FIG. 10 is a sectional side view of the convex plate of one embodiment of the apparatus.
Figure 11:
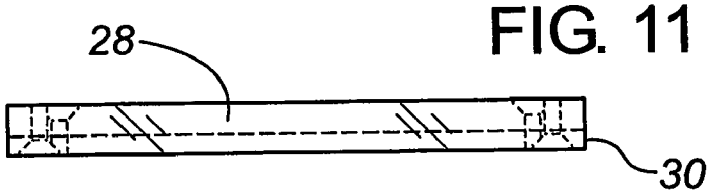
FIG. 11 is a sectional side view of the detachable plate of one embodiment of the apparatus.
Figure 12:
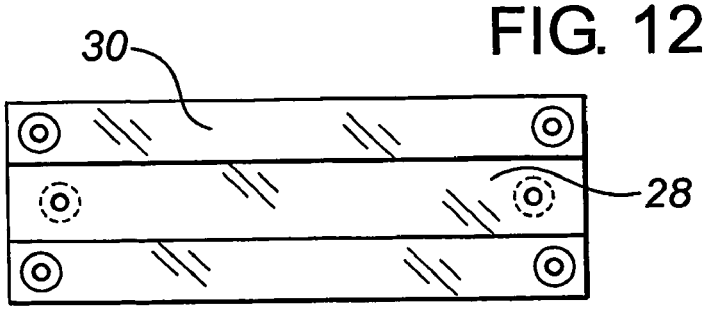
FIG. 12 is a sectional top view of the detachable plate of one embodiment of the apparatus.

In one embodiment, the convex grinding surface (20) is a detachable convex plate (30) as depicted in FIGS. 1, 9 and 10. The convex plate (30) is detachable to permit replacement when it becomes worn and to permit the use of convex plates of varying radii to match different skate widths. The use of the convex grinding surface (20) creates a corresponding concave grind profile and this results in a blade profile with maximized glide efficiency and with sharp edges for stopping and turning. The use of a fixed convex grinding surface (20) also results in a consistent grind profile during each sharpening. The convex plate (30) may insert into a corresponding groove (28) on the surface of the main frame (27) as depicted in FIGS. 1 and 12. This configuration provides stability preventing any movement during the grinding process. In another embodiment, the surface of the frame with the groove may be a detachable plate (30). This permits the use of convex plates with varying radii of curvature that would correspond with a detachable plate (30) with the correct groove width. The convex plate (30) may be anchored to the frame (26) by attachment means, such as screws or such other suitable attachment means commonly utilized in the art, extending through the bottom of the convex plate groove (28) into the convex plate (30) as shown in FIGS. 1 and 9–12.

The use and operation of one embodiment of the apparatus (10) will now be described having reference to FIGS. 1, 4 and 13. The electric motor (50) is activated turning the drive belt (52) which in turn rotates the drive shaft (34) and associated drive pulley (16). In another embodiment a power tool is attached to a drive bushing (14) and is engaged turning the drive pulley (16) attached to the drive bushing (14). In either embodiment this causes the grinding belt (21) to turn about first drive pulley (16) and about the second pulley (17) in a longitudinal orientation. A skate blade is inserted into the guidance slot (22) and a constant pressure is applied to the skate. The blade is directed by the guidance slot (22) towards the frame (26) inside the housing (12) such that the bottom edge of the blade contacts the abrasive surface of the grinding belt (21) on the convex grinding surface (20). The apparatus (10) is moved along the length of the skate blade several times until the skate blade is sharpened to the users satisfaction. The apparatus (10) may be held in one hand and the skate in the other. A fixed surface is therefore not required to operate the apparatus (10).

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A skate sharpening apparatus comprising:

(a) an electric motor;

(b) a drive shaft driven by the electric motor;

(c) an extendible frame having a first and second end, a first drive pulley connected to the drive shaft at its first end, a second pulley at its second end biasing means for pushing the first and second pulleys apart, and an elongated convex grinding surface;

(d) a grinding belt with an abrasive outer surface looping over both pulleys and the convex grinding surface; and (e) the electric motor, drive shaft, frame, grinding belt and pulleys being contained within a housing, the housing having a blade guidance slot aligned with the abrasive belt and convex grinding surface.

2. The apparatus of claim 1 wherein the biasing means is a coil spring.

3. The apparatus of claim 1 wherein the housing is comprised of two separable pieces.

4. The apparatus of claim 1 wherein the width of the guidance slot in the housing is adjustable for accommodating skate blades of varying thickness.

5. The apparatus of claim 1 further comprising blade guides for guiding the skate to the convex grinding surface, the blade guides being detachably mounted to the housing at the entrance of the guidance slot.

6. The apparatus of claim 1 wherein the housing defines an exhaust port adjacent to the grinding surface.

7. The apparatus of claim 1 wherein the frame is comprised of a main frame and an associated front pulley support.

8. The apparatus of claim 7 wherein the biasing means is mounted between the main frame and the front pulley support.

9. The apparatus of claim 1 wherein the convex grinding surface is a detachable convex plate.

10. The apparatus of claim 9 wherein the frame defines a groove for retaining the convex plate.

11. The apparatus of claim 1 wherein the housing defines a front handle and a rear handle for holding during use.

12. A skate sharpening apparatus for sharpening the blades of ice skates, the apparatus comprising:

(a) a drive bushing including means to releasably attach the drive bushing to a power tool;

(b) an extendible frame having a first and second end, a first drive pulley connected to the drive bushing at its first end, a second pulley at its second end, a biasing means pushing the first and second pulleys apart, and an elongated convex grinding surface;

(c) a grinding belt with an abrasive outer surface looping over both pulleys and the convex grinding surface; and (d) the frame, grinding belt and pulleys being contained within a housing, said housing having a blade guidance slot aligned with the abrasive belt and convex grinding surface.

13. The apparatus of claim 12 wherein the attachment means and drive bushing are comprised of an elongated arbor.

14. The apparatus of claim 12 wherein the biasing means is a coil spring.

15. The apparatus of claim 12 wherein the housing is comprised of two separable pieces.

16. The apparatus of claim 12 wherein the width of the guidance slot in the housing is adjustable for accommodating skate blades of varying thickness.

17. The apparatus of claim 12 further comprising blade guides for guiding the skate to the convex grinding surface, the blade guides being detachably mounted to the housing at the entrance of the guidance slot.

18. The apparatus of claim 12 wherein the housing defines an exhaust port adjacent to the grinding surface.

19. The apparatus of claim 12 wherein the frame is comprised of a main frame and an associated front pulley support.

20. The apparatus of claim 19 wherein the biasing means is mounted between the main frame and the front pulley support.

21. The apparatus of claim 12 wherein the convex grinding surface is a detachable convex plate.

22. The apparatus of claim 21 wherein the frame defines a groove for retaining the convex plate.

23. A skate blade sharpening apparatus, the apparatus comprising:

(a) an arbor having attachment means for attaching to a hand-held power tool;

(b) an extendible main frame having a first drive pulley connected to the arbor at a first end of said main frame, and a front pulley support at a second end of said main frame, the front pulley support holding a second pulley;

(c) biasing means mounted between the main frame and the front pulley support;

(d) a convex grinding surface mounted to the surface of the main frame;

(e) a grinding belt with an abrasive outer surface looping over both pulleys and the convex grinding surface; and (f) the main frame, pulley support, grinding belt and pulleys being contained within a housing, the housing having a blade guidance slot aligned with the grinding belt at the convex grinding surface.

24. The apparatus of claim 23 wherein the attachment means of the arbor is a threaded cavity defined by the arbor.

25. The apparatus of claim 23 wherein the biasing means is a coil spring.

26. The apparatus of claim 23 wherein the housing is comprised of two separable pieces.

27. The apparatus of claim 23 wherein the width of the guidance slot in the housing is adjustable for accommodating skate blades of varying thickness.

28. The apparatus of claim 23 wherein the housing defines an exhaust port adjacent to the grinding surface.

29. The apparatus of claim 23 wherein the convex grinding surface is a detachable convex plate.

30. The apparatus of claim 29 wherein the frame defines a groove for retaining the convex plate.

* * * * *